United States Patent [19]

Tocquet

[11] 4,287,582

[45] Sep. 1, 1981

[54] PIEZO TRANSDUCERS WITH MECHANICAL AMPLIFICATION FOR VERY LOW FREQUENCIES, AND ACOUSTIC ANTENNAS

[75] Inventor: Bernard Tocquet, Sanary-sur-Mer, France

[73] Assignee: Etat Francais represente par le Delegue General pour l'Armement, Paris, France

[21] Appl. No.: 37,055

[22] Filed: May 8, 1979

[30] Foreign Application Priority Data

May 8, 1978 [FR] France ..... 78 13466

[51] Int. Cl.[3] ..... H04R 17/00

[52] U.S. Cl. ..... 367/163; 367/155; 367/160; 367/174

[58] Field of Search ..... 367/155, 154, 163, 141, 367/157, 166, 171, 174; 310/328, 330, 331, 334

[56] References Cited

U.S. PATENT DOCUMENTS

| | | | |
|---|---|---|---|
| 3,258,738 | 6/1966 | Merchant | 367/155 |
| 3,614,486 | 10/1971 | Smiley | 310/323 |
| 3,649,857 | 3/1972 | Knappe | 310/328 |

*Primary Examiner*—Harold J. Tudor

*Attorney, Agent, or Firm*—Stevens, Davis, Miller & Mosher

[57] ABSTRACT

A new piezoelectric transducer incorporated with a mechanical amplifier is described. The transducer comprises a rigid base plate; two lateral plates whose lower edge is connected to the plate by a thin portion; a stack of piezoelectric elements having alternate electrodes; a horn formed of a flexible elastic diaphragm which connects together the upper edges of the two plates; an enclosure and a sealing skin which is acoustically transparent. The tranducer is capable of emitting or receiving high power acoustic waves of very low frequencies including for instance, a few Hertz to 500 Hz.

9 Claims, 8 Drawing Figures

FIG. 1
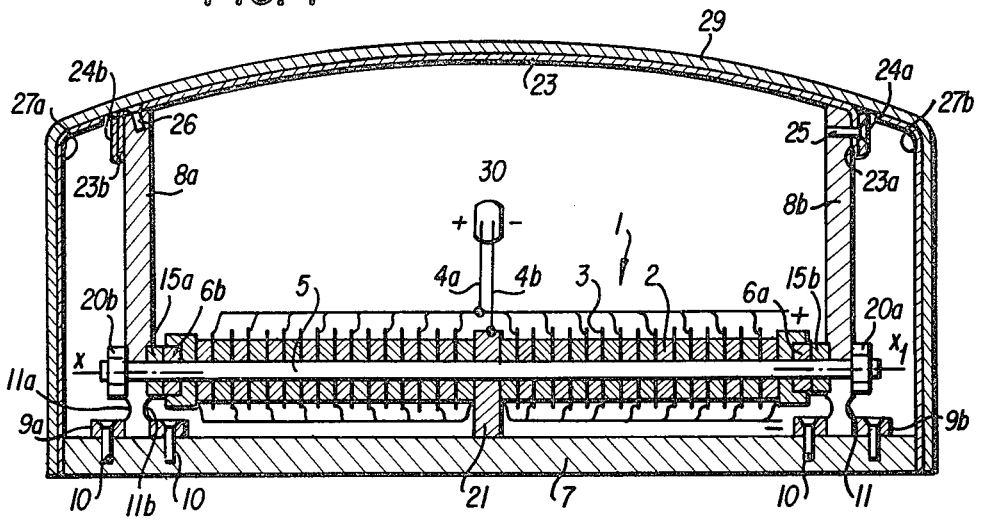
FIG. 2
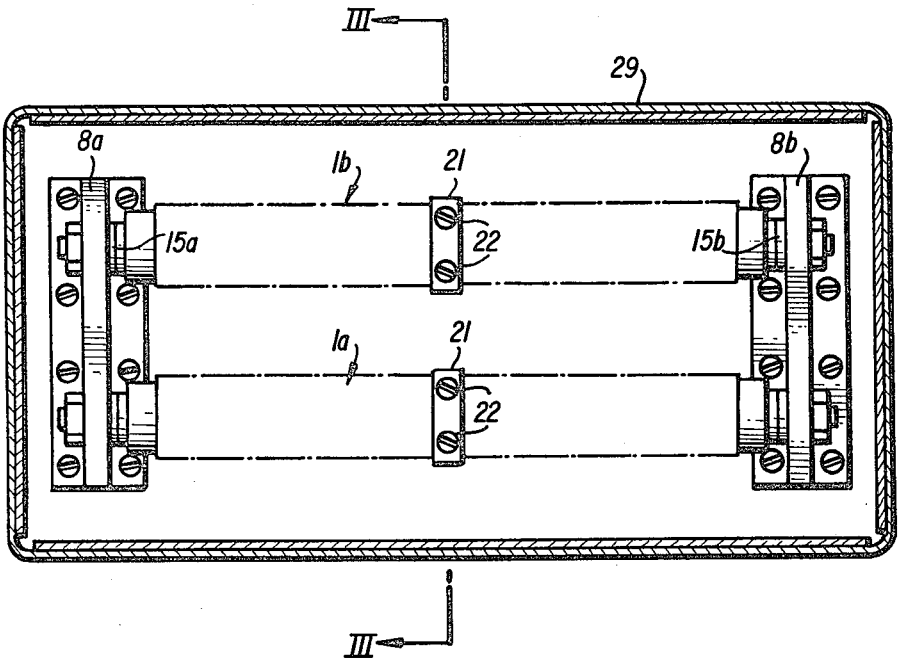
FIG. 4
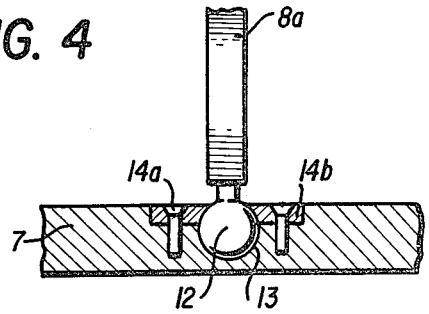
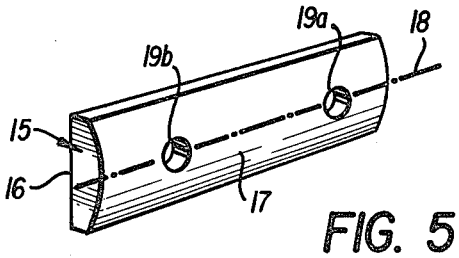
FIG. 5

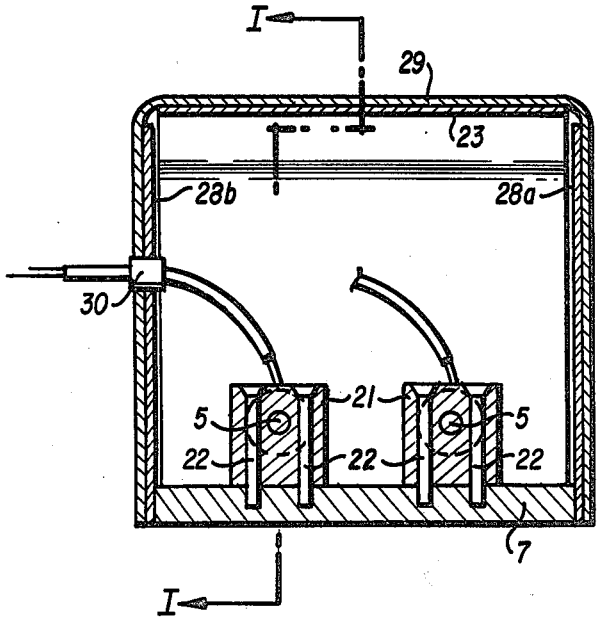
FIG. 3
FIG. 6
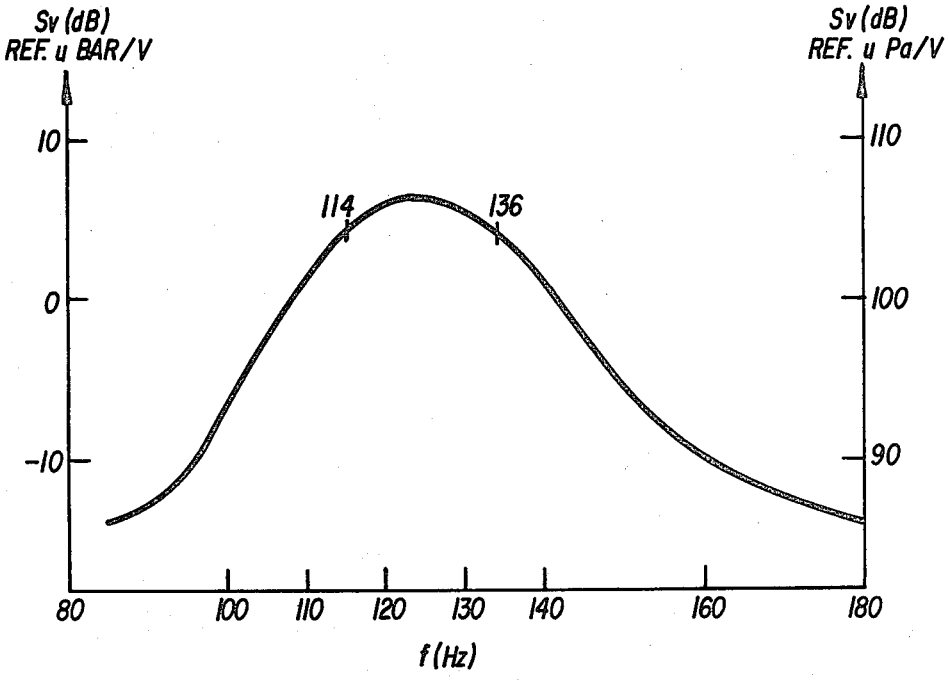

PIEZO TRANSDUCERS WITH MECHANICAL AMPLIFICATION FOR VERY LOW FREQUENCIES, AND ACOUSTIC ANTENNAS

BACKGROUND OF THE INVENTION

The present invention relates to piezoelectric transducers for very low frequencies of between a few Hz and 500 Hz which comprise a mechanical amplifier as well as antennas constructed with such transducers. Specifically, the subject matter of the invention related to the construction of acoustic devices used, in particular, in submarine acoustics.

It is known that for a given intensity, the amplitude of acoustic vibrations is greater at lower frequencies. At very low frequencies of a few Hz to 500 Hz, the performance of piezoelectric transducers is limited by the properties of the piezoelectric materials, which limit amplitudes of vibration.

SUMMARY OF THE INVENTION

The object of the present invention is to provide mechanical amplification of the deformations of piezoelectric transducers so that one can construct peizoelectric transducers for high power operation at very low frequencies.

This object is achieved by means of piezoelectric transducers for operation at very low frequencies which comprise:

at least one stack of piezoelectric elements having two axially opposite ends;

two levers placed on opposite sides of said stacks in such a manner that each of the two ends of each stack rests against one of the two levers near the point of support of the lever;

and a horn formed of a flexible elastic diaphragm for connecting the ends of the two levers together.

In accordance with a preferred embodiment, a transducer in accordance with the invention comprises:

a rigid base plate;

two flat lateral plates which are located on the same side of said base plate and are connected to it by semi-embedment or by an articulation along one of their edges;

at least one stack of piezoelectric elements having two axially opposite ends, each in contact with one of said lateral plates near the edge of said lateral plates connected to the base plate;

a horn formed of a flexible elastic diaphragm which connects together the two edges of the two lateral plates opposite the two edges which are connected to the base plate;

and a gas-filled enclosure which contains the piezoelectric stacks and the horn which constitutes one of the faces, said enclosure being surrounded in an airtight manner by a deformable and acoustically transparent diaphragm which also encloses the horn.

Each stack of piezoelectric elements preferably has a fixed central point and two half stacks located on opposite sides of said fixed point.

In accordance with one particular embodiment of the invention, a transducer has two identical subassemblies located on opposite sides of the same base plate and symmetrical with respect to said plate.

The invention results in a new piezoelectric transducer for transmitting or receiving, which makes it possible to obtain high amplitudes and therefore high power at very low frequencies of between a few Hz and 500 Hz while having a relatively small dimension.

The amplitude of deformations of the piezoelectric stacks is multiplied by a mechanical amplifier associated with these stacks.

This amplifier is formed by the two levers which multiply the amplitude of the oscillations by a coefficient equal to the ratio between the two lever arms and, on the other hand, by the elastic diaphragm which serves as the horn and which interconnects the free ends of the two levers in such a manner that when the distance between the ends of the two levers varies in one direction or the other, this variation results in flexural deformations of the diaphragm. The amplitude of the deformations at the center of the membrane is greater than the amplitude of the variations in the distance between the ends of the two levers.

The elastic diaphragm constitutes a horn which can be placed in contact with the water and which can therefore transmit to the water or receive acoustic waves having a large amplitude while the deformations of the piezoelectric elements are much smaller than the deformations of the flexible diaphragm.

The flexible diaphragm may be flat or, preferably, curved. The curving of the flexible diaphragm is obtained by means of a flexural prestressing of said plate in such a manner that it remains at all times compressed, even when the distance between the two ends of the levers is at a maximum.

The embodiment comprising two identical subassemblies arranged symmetrically with respect to the same base plate has the advantage of making it possible to reduce the thickness of the base plate.

The transducers of the invention make it possible to construct antennas having a single base plate, which may be flat or cylindrical, on which there is arranged a network of transducers aligned along rows and/or columns.

One advantage of the devices in accordance with the invention resides in the fact that they are mechanical devices having several natural resonant frequencies, including certain very low frequencies between a few Hertz and 500 Hz making it possible to select the lowest of these resonant frequencies and obtain a sensitivity curve SV, measured in decibles, which has a pronounced peak located in this very low frequency band.

The following description refers to the accompanying drawings which show, by way of illustration and not of limitation, various embodiments of transducers and antennas in accordance with the invention.

DESCRIPTION OF THE FIGURES

FIG. 1 is a longitudinal section along the line I—I of a transducer in accordance with the invention.

FIG. 2 is a plan view of the transducer of FIG. 1.

FIG. 3 is a cross section along the line III—III.

FIG. 4 is a partial vertical section through a variant embodiment of FIG. 1.

FIG. 5 is a perspective view of a support piece.

FIG. 6 is a section (sic) showing the sensitivity of a transducer in accordance with FIGS. 1 and 2 as a function of the frequency.

DESCRIPTION OF A PREFERRED EMBODIMENT

Figure 7:
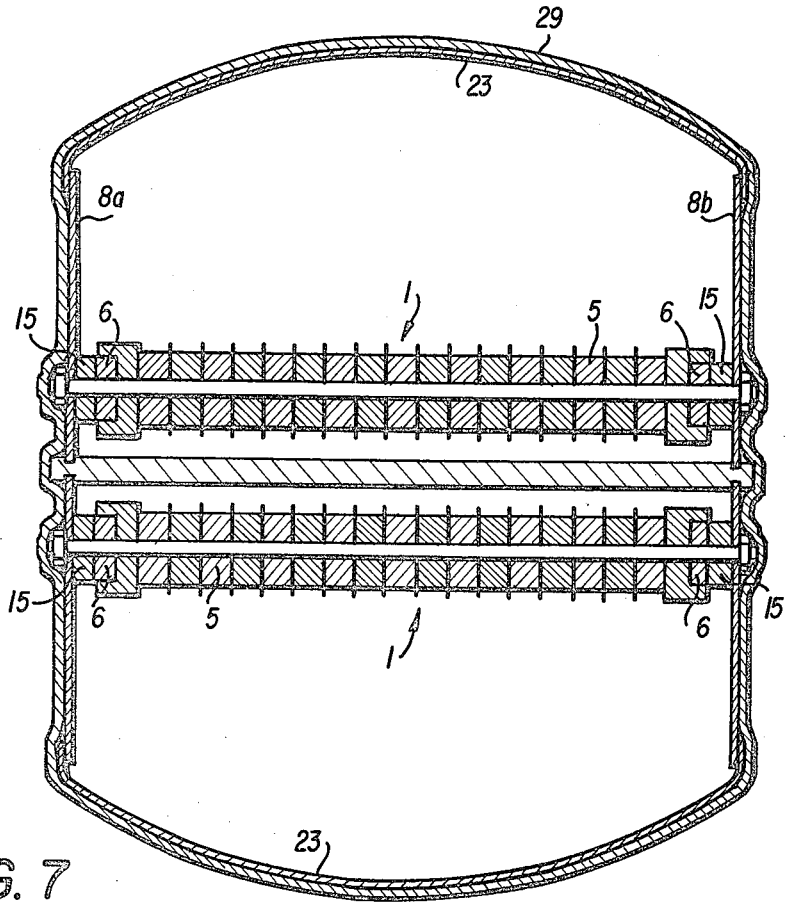
FIG. 7 shows a variant transducer according to the invention.

FIGS. 1, 2 and 3 show a piezoelectric transducer which is intended either to emit acoustic waves into the water or to receive them. This transducer has one or more stacks 1 of piezoelectric elements.

In the figures there are shown by way of example, two stacks 1*a* and 1*b*. Each stack is composed of piezoelectric elements 2, for instance wafers of a piezoelectric ceramic, between which electrodes 3 are interposed. The electrodes 3 are alternately connected to one or the other of two electric wires 4*a* and 4*b* representing opposite polarity.

The elements 2 and the electrodes 3 are held clamped together by a central stressing rod 5 of axis xxl which is threaded at its two ends, and two nuts 6*a*, 6*b* which are screwed onto the two threaded ends so as to place the rod 5 under tension.

Such a stack of piezoelectric elements and electrodes is well known and it is known that it deforms parallel to the axis xxl when a sinusoidal tension is applied between the wires 4*a* and 4*b* and that conversely a sinusoidal tension is collected between the wires 4*a* and 4*b* if the transducer serves as the receiver of acoustic waves.

However the amplitude of the axial deformations of each piezoelectric element is limited by the nature of its materials. If it is desired to emit or receive acoustic waves of a very low frequency and having sufficient power it is necessary to use stacks comprising a very large number of elements, which however, results in very cumbersome transducers.

An immersed transducer in accordance with the invention makes it possible to obtain high amplitudes of the horn deformation; that is to say movement of the surface which is in contact with the water and transmits the acoustic waves to the water in the case of a transmitter, or receives the acoustic waves in the case of a receiver. This result is obtained by means of a transducer whose dimensions remain relatively small as compared with those which would be necessary to obtain the same amplitudes in the case of a traditional transducer having only one stack of piezoelectric elements.

A transducer in accordance with the invention comprises a very rigid base plate 7. It has two identical flat side plates 8*a* and 8*b* which are perpendicular to the base plate 7, on the same side as the latter. These side plates have, for instance, a rectangular shape. The lower edge of each plate 8*a* and 8*b* is connected to the base plate for instance by means of plates 9*a* and 9*b* each of which comprises two half plates fastened to the base plate 7 by screws 10 and which clamp the lower edge of the plates 8*a* and 8*b* between them. Each plate 8*a*, 8*b* has, along its lower edge directly below plates 9*a* and 9*b*, a thin portion 11 formed for instance of two grooves 11*a* and 11*b* located on opposite sides of the plate so that the plates 8*a* and 8*b* can deform by pivoting around the thin portion 11.

In other words, the plates 8*a* and 8*b* are fastened in the form of brackets onto the plate 7 by semi-embedments.

In accordance with a variant shown in FIG. 4, this semi-embedment can be replaced by an articulation around an axis parallel to the lower edge of each plate. In this case, the side plate 8*a* has, along its lower edge, a bead 12 of circular section which is engaged in a groove 13 of circular section provided in the base plate 7. Two half plates 14*a* and 14*b* are screwed onto the plate 7 and hold the bead 12 in its housing while permitting it to pivot. Of course, this articulation can be replaced by any other equivalent type of articulation.

The stacks 1*a* and 1*b* extend above the base plate 7 perpendicular to the two plates 8*a* and 8*b*.

The two axially opposite ends of the stack 1 are pressed against the inner faces of the two plates 8*a* and 8*b* slightly above the thin portion 11. The pressing is effected by means of an intermediate bearing 15*a*, 15*b*. A bearing 15 is shown in perspective in FIG. 5. This part has a first flat side face 16 which is pressed against one of the side plates 8 and a second side face 17, opposite the face 16, which is pressed against one end of the stack 1.

The face 17 is a portion of a cylindrical surface of circular arc so that the pressing of the stack against the bearing face takes place along a line which is the central generatrix 18 of the face 17. Each part 15 has two holes 19*a* and 19*b* for the passage of the extensions of the rod 5 which pass through the plates 8*a* and 8*b*. Nuts 20*a* and 20*b* are screwed onto these extensions in order to hold the stacks 1*a* and 1*b* in place.

The cylindrical shape of the faces 17 of the bearing part 15 make it possible to precisely determine the bearing line 18 and therefore the distance which separates the latter from the line around which the plates 8*a* and 8*b* can pivot, that is to say from the thin portion 11 or the center of the bead 12.

The plates 8*a* and 8*b* serve as levers the thin portions 11 or beads 12 constituting the support point while the distance between said support point and the bearing line 18 constitutes the small arm of the lever. It is pointed out that the bearings 15*a* and 15*b* could be reversed so that their cylindrical face 17 is placed in contact with a side plate 8*a* or 8*b*.

In the examples shown in FIGS. 1 to 3, each stack 1*a*, 1*b* is composed of two half stacks which are symmetrical with respect to a central fixed point 21 which is formed, for instance, of a plate fastened to the base plate 7 by screws 22.

The transducer shown in FIGS. 1, 2 and 3 furthermore comprises a horn 23, which is the active surface, in acoustic contact with the water and moves therewith.

This horn is formed of a flexible elastic diaphragm, for instance a thin plate of spring steel having a thickness of a few millimeters.

This plate is fastened by an suitable means along each of its two side edges to an upper edge of one of the side plates 8*a* and 8*b*. For example, the two side edges of the plate 23 are bent to form the folds 23*a* and 23*b* and these folds are held clamped between a plate 8*a* or 8*b* and a fastening plate 24*a*, 24*b* fastened to the plate 8*a* or 8*b* by screws 25. Screws 26 threaded into the thickness of the plates 8*a* and 8*b* can reinforce this attachment.

The plate 23 is preferably curved, the convex face preferably facing the side opposite the base plate 7.

In accordance with one preferred embodiment, a plate having a width in the direction parallel to the axis xxl which is slightly greater than the distance between the two side plates 8*a* and 8*b* is used and it is compressed slightly in the direction parallel to the axis xxl before fastening it along the two upper edges of the plates 8*a* and 8*b*.

The transducer in accordance with FIGS. 1 to 3 comprises a water-tight enclosure comprised of two side plates 27*a* and 27*b* parallel to the plates 8*a* and 8*b* and of two side plates 28*a* and 28*b*, visible in FIG. 3, and a flexible diaphragm 29 forming a sealing skin which surrounds the side plates 27*a*, 27*b*, 28*a*, 28*b* and the horn 23.

The skin 29 consists of a material having an acoustic impedance close to that of water so that it is acoustically transparent and does not disturb the transmission of the waves between the water and the active surface of the horn 23. It is glued onto the horn 23 so that it participates in the movements of the latter. The skin 29 is, for instance, a thin skin of rubber or of a flexible plastic material. A slight play is present between the plates 8*a* and 8*b* and the horn 23 and, the side plates 27*a*, 27*b*, 28*a*, 28*b* of the enclosure, so that the enclosure does not interfere with the movements of the horn and of the side plates 8*a*, 8*b*.

The inside of the hermetic enclosure is filled with gas. If the transducer is to be used in an immersed condition, this gas is maintained at an equal pressure with the outside, for instance by means of a source of compressed gas provided with a pressure reducer which is regulated as a function of the depth of immersion.

As a variant, the two walls 27*a* and 27*b* of the enclosure can be eliminated and the diaphragm 29 can be glued directly on the two outer faces 8*a* and 8*b*. In this case, the plates 8*a* and 8*b* constitute acoustically active surfaces.

FIGS. 1 and 3 show a water-tight connector 30 via which the electrical wires 4*a* and 4*b* pass through the wall 28*b*.

The operation of this transducer in the transmitter mode is as follows: When the stack 1 deforms longitudinally along the axis xxl, the deformations are communicated to the two levers 8*a* and 8*b* which deform, pivoting around their point of support. The displacements of the upper ends of the levers 8*a* and 8*b* are multiplied by the ratio between the two lever arms. The variations in distance between the two upper edges of the two levers 8*a* and 8*b* produce flexural deformations of the elastic diphragm 23. The displacements at the center of the diaphragm in the direction perpendicular to the base plate 7 are greater than the displacements of the upper ends of the two levers 8*a* and 8*b*.

FIG. 6 shows measurements of the sensitivity SV of the transducer according to the invention as a function of the frequency. It will be recalled that the sensitivity SV measured in decibles corresponds to 20 times the logarithm of the ratio between the acoustic pressure measured either in microbars or in micropascals and the voltage in volts.

FIG. 6 shows, on the abscissa axis, a frequency range of between 80 Hz and 180 Hz. On the ordinate there is shown, on the left, the sensitivity measured in accordance with the reference u-bar/volt and on the right measured in accordance with the reference u-pascal/-volt. A maximum sensitivity is obtained for a resonant frequency on the order of 125 Hz.

FIG. 7 is a longitudinal section through a variant embodiment of a transducer in accordance with the invention.

The latter is composed of two half-transducers which are arranged symmetrically with respect to a base plate 7 which is common to the two half transducers. Each of the two half transducers is identical to the one which is shown in FIGS. 1, 2 and 3, and the parts homologous to those of said figures are represented by the same reference numbers. However, there is shown in FIG. 7 an embodiment in accordance with the variant in which the side walls 27*a* and 27*b* of the enclosure are eliminated and the skin 29 is glued directly onto the horns 23 and onto the side plates 8*a* and 8*b*.

One advantage of this embodiment is that it makes it possible to use a base plate 7 which is less rigid, since it is stressed in flexure symmetrically by the two half transducers. Furthermore, a transducer in accordance with FIG. 7 is very omnidirectional.

Figure 8:
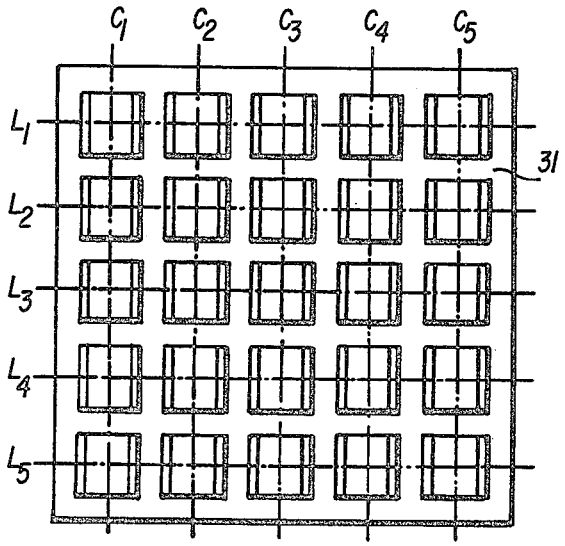
FIG. 8 shows an acoustic antenna composed of a network of transducers in accordance with the invention.

FIG. 8 shows diagrammatically an embodiment of an acoustic antenna comprising 16 transducers in accordance with the invention, for instance 25 hydrophones, arranged in the network along five rows L1 to L5 and five columns C1 to C5. Each transducer is represented diagrammatically by a square, two opposite sides of which are drawn with a double line and represent the two lateral plates 8*a* and 8*b* of a transducer.

All the transducers are fastened to the same rigid plate 31 which serves as base plate common to all the transducers.

The plate 31 may be flat, curved or cylindrical in the form of the antenna. Two networks of transducers can be arranged symmetrically on opposite sides of the plate 31.

Of course, the various component parts of the transducers which have just been described by way of example can be replaced by equivalent parts which satisfy the same functions without thereby going beyond the scope of the invention.

What is claimed is:

1. A low frequency piezoelectric transducer for receiving and transmitting acoustic waves in water comprising:

at least one stack of piezoelectric elements having two axially opposite ends;

two levers placed on opposite sides of said stacks so that each of the two ends of each stack rests against one of the two levers near a point of support of one end of each of said levers;

a rigid base plate on which said one end of the two levers are supported;

and a horn formed of a flexible elastic diaphragm connecting together the remaining ends of the two levers.

2. A transducer according to claim 1, characterized by the fact that each end of said stacks of piezoelectric elements is pressed against said lateral plates via an intermediate bearing part having a first flat lateral face and a second lateral face opposite the first which is cylindrical.

3. An antenna composed of transducers according to claim 1, characterized by the fact that it comprises a common base plate on which there are arranged one or more rows and/or columns of unit transducers.

4. A transducer according to claim 1, characterized by the fact that the said stacks of piezoelectric elements have a central fixed point connected to said base plate and two half stacks which are symmetrical with respect to said fixed point.

5. A transducer according to claim 4, characterized by the fact that said elastic flexible diaphragm is curbed.

6. A transducer according to claim 4, characterized by the fact that said elastic flexible diaphragm is prestressed in flexure.

7. A piezoelectric transducer for transmitting and receiving acoustic waves in water comprising:

a rigid base plate;

two flat lateral plates which are located on the same side of said base plate and which are pivotally connected to it along one of their edges;

at least one stack of piezoelectric elements having two axially opposite ends which are in contact respectively with each of the said lateral plates near the edge of the latter which is connected to the base plate;

a horn formed of an elastic flexible diaphragm which connects together the two edges of the two lateral plates which are opposite the two edges connected to the base plate;

and means for forming a gas filled enclosure with said horn whereby said piezoelectric stacks are enclosed, said horn constituting a surface of the resulting enclosure, said means being hermetically surrounded by a deformable acoustically transparent diaphragm.

8. A piezoelectric transducer for transmitting and receiving acoustic waves in water comprising:

a rigid base plate;

two flat lateral plates which are located on the same sides of said base plate and which are connected to it in a pivotal relationship along one of their edges;

at least one stack of piezoelectric elements having two axially opposite ends which are in contact with each of the said lateral plates respectively near the edge of the latter which is connected to the said base plate;

a horn formed of a flexible elastic diaphragm which connects together the two edges of the two lateral plates which are opposite the two edges connected to the said base plate;

and a gas-filled enclosure which contains the said piezoelectric stacks, said horn and said lateral plates constituting walls of said enclosure which enclosure is hermetically surrounded by a deformable acoustically transparent diaphragm, said diaphragm surrounding said horn and said lateral plates.

9. A piezoelectric transducer comprising:

a rigid base plate;

first and second stacks of piezoelectric elements located on opposite sides of said base plate, each of said stacks having first and second ends;

first and second pairs of lateral plates located on opposite sides of said base plate, said lateral plates having one end pivotally connected to said base plate; a portion of each lateral plate being in contact with an end of a piezoelectric element;

a flexible diaphragm connecting together the remaining ends of said lateral side plates; and, means for enclosing said stacks in a gas environment, said diaphragm forming a surface of the enclosure, and, means for hermetically sealing said enclosure with an deformable acoustically transparent surface.

* * * * *